US010856679B2

(12) United States Patent
Arora

(10) Patent No.: US 10,856,679 B2
(45) Date of Patent: Dec. 8, 2020

(54) ILLUMINATION ELEMENT RECEPTACLE

(71) Applicant: Just Funky LLC, Richfield, OH (US)

(72) Inventor: Rajnish Arora, Richfield, OH (US)

( * ) Notice: Subject to any disclaimer, the term of this patent is extended or adjusted under 35 U.S.C. 154(b) by 0 days.

(21) Appl. No.: 15/663,158

(22) Filed: Jul. 28, 2017

(65) Prior Publication Data

US 2019/0029447 A1 Jan. 31, 2019

(51) Int. Cl.

| | |
|---|---|
| ***A47G 19/22*** | (2006.01) |
| ***H05B 45/00*** | (2020.01) |
| ***H05B 47/10*** | (2020.01) |

(52) U.S. Cl.

CPC ..... *A47G 19/2227* (2013.01); *A47G 19/2255* (2013.01); *H05B 45/00* (2020.01); *H05B 47/10* (2020.01); *A47G 2019/2238* (2013.01)

(58) Field of Classification Search

USPC ..... 362/96, 101; 99/341

See application file for complete search history.

(56) References Cited

U.S. PATENT DOCUMENTS

2010/0165611 A1* 7/2010 Catalano ..... F21V 7/06 362/184
2011/0262114 A1* 10/2011 Montgomery ..... F24F 1/025 392/365
2012/0002404 A1* 1/2012 Ma ..... A45C 3/00 362/154
2015/0292729 A1* 10/2015 Sutton ..... F21V 33/0024 362/101

* cited by examiner

*Primary Examiner* — Matthew Mikels
(74) *Attorney, Agent, or Firm* — Amin, Turocy & Watson, LLC; Nilesh S. Amin

(57) ABSTRACT

Articles of manufacture, systems and methods facilitating light emitting diode (LED) receptacles are provided herein. In one embodiment, an article of manufacture comprises: an inner wall; an outer wall, wherein the inner wall and the outer wall form a double walled receptacle; circuitry disposed between the inner wall and the outer wall, the circuitry comprising at least one light emitting diode; and a control device coupled to the at least one light emitting diode, wherein the control device is configured to control illumination of the at least one light emitting diode.

14 Claims, 12 Drawing Sheets

ILLUMINATION ELEMENT RECEPTACLE

TECHNICAL FIELD

The subject disclosure relates generally to receptacles and, for example, to systems, apparatus and methods facilitating receptacles having illumination elements.

DETAILED DESCRIPTION

Figure 1A:
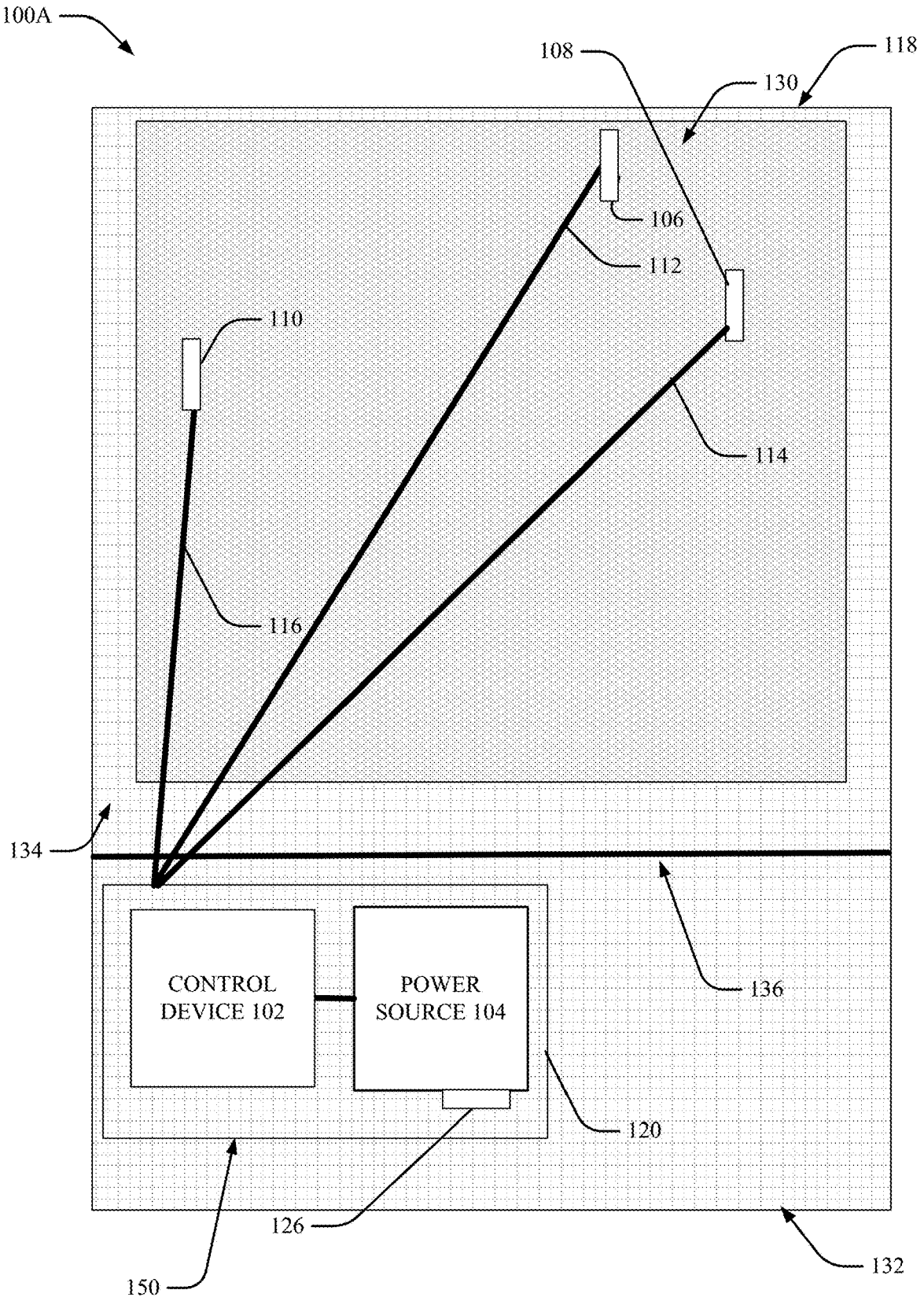
FIGS. 1A, 1B and 1C illustrate example, non-limiting partial views of schematic diagrams of illumination element receptacles (IERs) in accordance with one or more embodiments described herein.

One or more embodiments are now described with reference to the drawings, wherein like reference numerals are used to refer to like elements throughout. In the following description, for purposes of explanation, numerous specific details are set forth in order to provide a thorough understanding of the various embodiments. It is evident, however, that the various embodiments can be practiced without these specific details (and without applying to any particular networked environment or standard).

As used in this disclosure, in some embodiments, the terms "component," "system" and the like are intended to refer to, or comprise, a circuitry-related entity, an entity powered by one or more power sources, a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, computer-executable instructions, a program, an integrated circuit, one or more circuit components, and/or a computer. By way of illustration and not limitation, both an application running on a server and the server can be a component.

One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software application or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. While various components have been illustrated as separate components, it will be appreciated that multiple components can be implemented as a single component, or a single component can be implemented as multiple components, without departing from example embodiments.

Further, the various embodiments can be implemented as a method, apparatus or article of manufacture using standard programming and/or engineering techniques to produce software, firmware, hardware or any combination thereof to control a computer, control unit, power source or one or more illumination elements to implement the disclosed subject matter. The term "article of manufacture" as used herein is intended to encompass, but is not limited to, a computer program accessible from any computer-readable (or machine-readable) device or computer-readable (or machine-readable) storage/communications media. For example, computer readable storage media can comprise, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Furthermore, the terms "device," "component," "system," "communication device," "entity" and the like are employed interchangeably throughout, unless context warrants particular distinctions among the terms. It should be appreciated that such terms can refer to human entities or automated components supported through artificial intelligence (e.g., a capacity to make inference based on complex mathematical formalisms), which can provide simulated vision, sound recognition and so forth.

One or more embodiments described herein comprise an article of manufacture (AOM). The AOM can comprise a receptacle having: an inner wall; an outer wall, wherein the inner wall and the outer wall form a double walled receptacle; and circuitry disposed between the inner wall and the outer wall, the circuitry comprising: at least one light emitting diode. The AOM can also comprise a control device coupled to the at least one light emitting diode, wherein the control device is configured to control illumination of the at least one light emitting diode. In some embodiments, the AOM further comprises a power source coupled to the control device and configured to provide power to the control device and the at least one light emitting diode. In some embodiments, the power source is removably coupled to the circuitry and/or comprises at least one battery. The at least one battery can be coupled to a switch that controls the at least one battery to provide power to the control device and the at least one light emitting diode. In some embodiments, the switch can be located on the outside of the receptacle so that the switch accessible to a consumer that may hold the receptacle in his/her hand. The switch can be at the bottom of the receptacle or near the bottom region on the side of the receptacle. In some embodiments, the control device and/or the power source are located in a removable portion of the receptacle. The removable portion of the receptacle can be at the bottom of the receptacle and/or on a side or top of the receptacle in different embodiments. In various embodiments, the receptacle can be a cup configured for holding fluid, a basket, a mug or any other receptacle of any number of different sizes or configurations. While the drawings show receptacles that are cups and mugs, in other embodiments, the receptacle can be embodied in any number of shapes.

In some embodiments, the AOM further comprises a power connection component coupled to the control device, wherein the power connection component is configured to be removably coupled to a power source external to the article of manufacture to provide power to the control device and the at least one light emitting diode.

In some embodiments, the AOM further comprises at least one other light emitting diode, wherein the control device is configured to output a signal causing the at least one light emitting diode and the at least one other light emitting diode to have staggered illumination, wherein the staggered illumination comprises the at least one light emitting diode commencing illuminating at a first time and the at least one other light emitting diode commencing illumination at a second time, wherein the second time is later than the first time. In some embodiments, the control device is configured to output a signal causing the at least one light emitting diode and the at least one other light emitting diode to illuminate. In some embodiments, the control device comprises a power shut off component configured to automatically shut off power from the at least one battery. The power shut off component is further configured to automatically shut off power from the at least one batter after a defined amount of time that the at least one battery has commenced providing power to the at least one light emitting diode.

In various embodiments, the outer wall can be comprised of any number of materials including, but not limited to, plastic, ceramic, porcelain, wood, stone or the like. In some embodiments, the light emitting diode is attached to the inner wall and/or the outer wall via adhesive. In some embodiments, the light emitting diode is attached the inner wall and/or the outer wall via mechanical apparatus including, but not limited to, screws, pins or the like.

One or more other embodiments can comprise a method of operation. The method of operation can comprise: controlling, by a control device comprising a processor, provisioning of first power to a first light emitting diode positioned on or within a receptacle having an inner wall and an outer wall, wherein provisioning of the first power causes the first light emitting diode to become illuminated; and controlling, by the control device, provisioning of second power to a second light emitting diode positioned on or within the receptacle, wherein provisioning of the second power causes the second light emitting diode to become illuminated, wherein the first power and the second power are emitted from at least one battery removably coupled to the first light emitting diode and the second light emitting diode.

In some embodiments, the controlling the provisioning the first power and the controlling the provisioning of the second power causes the first light emitting diode and the second light emitting diode to be powered on concurrently. In some embodiments, the controlling the provisioning the first power and the controlling the provisioning of the second power causes the first light emitting diode to be powered on during a first time period and causes the second light emitting diode to be powered on during a second time period, wherein the first time period and the second time period are non-overlapping.

In some embodiments, the method comprises: generating, by the control device, a signal to cause the at least one battery to cease providing power to the at least one light emitting diode after a defined amount of time since commencement of providing power by the at least one battery.

One or more other embodiments can comprise a system comprising: a receptacle having a plurality of illumination elements configured to illuminate and disposed on or within the receptacle; and a power source coupled to a plurality of electrical connections respectively coupled to the plurality of illumination elements to provide power to the illumination elements, wherein the power source is configured to illuminate one or more of the plurality of illumination elements concurrently.

Figure 1B:
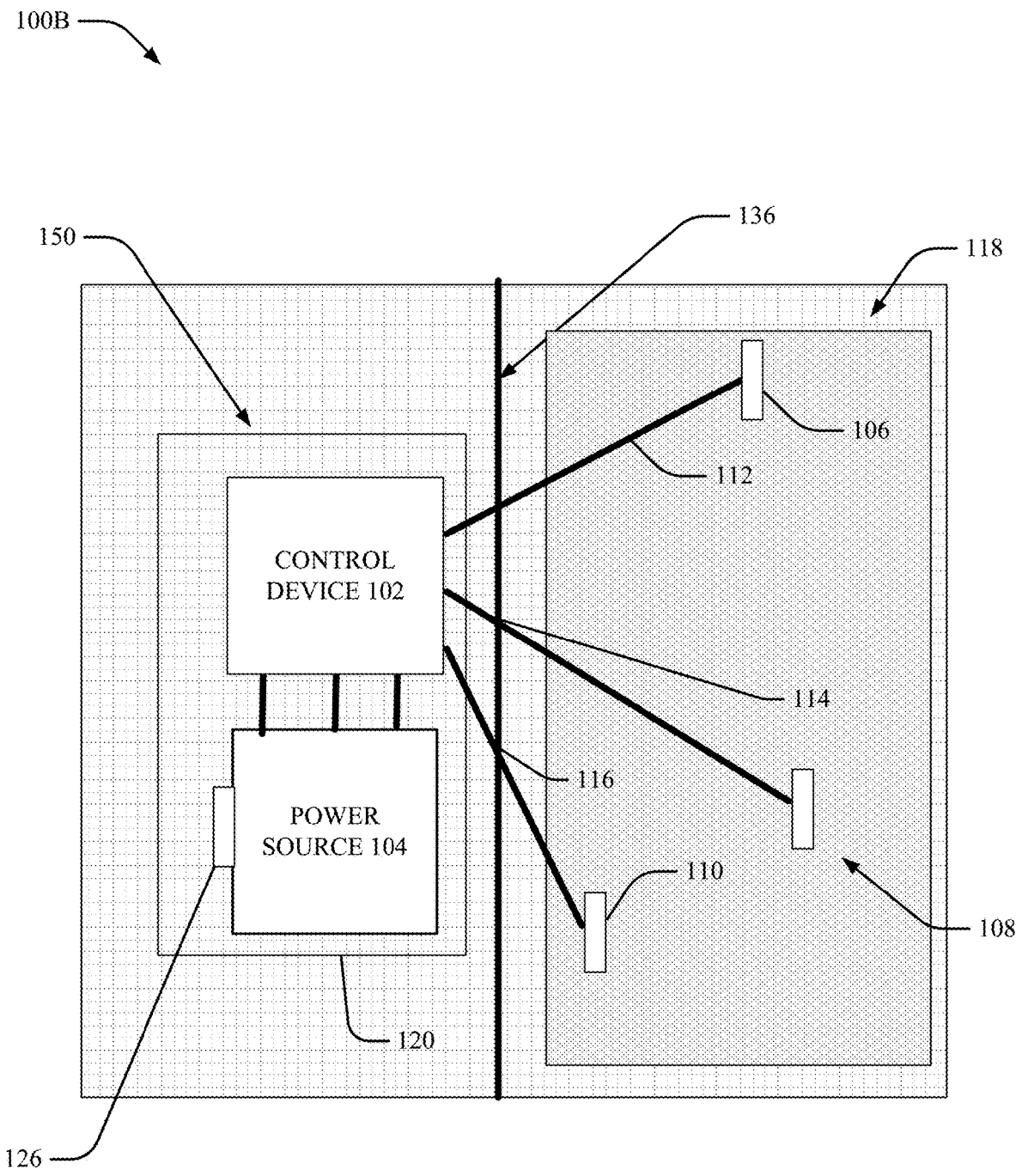
Figure 1C:
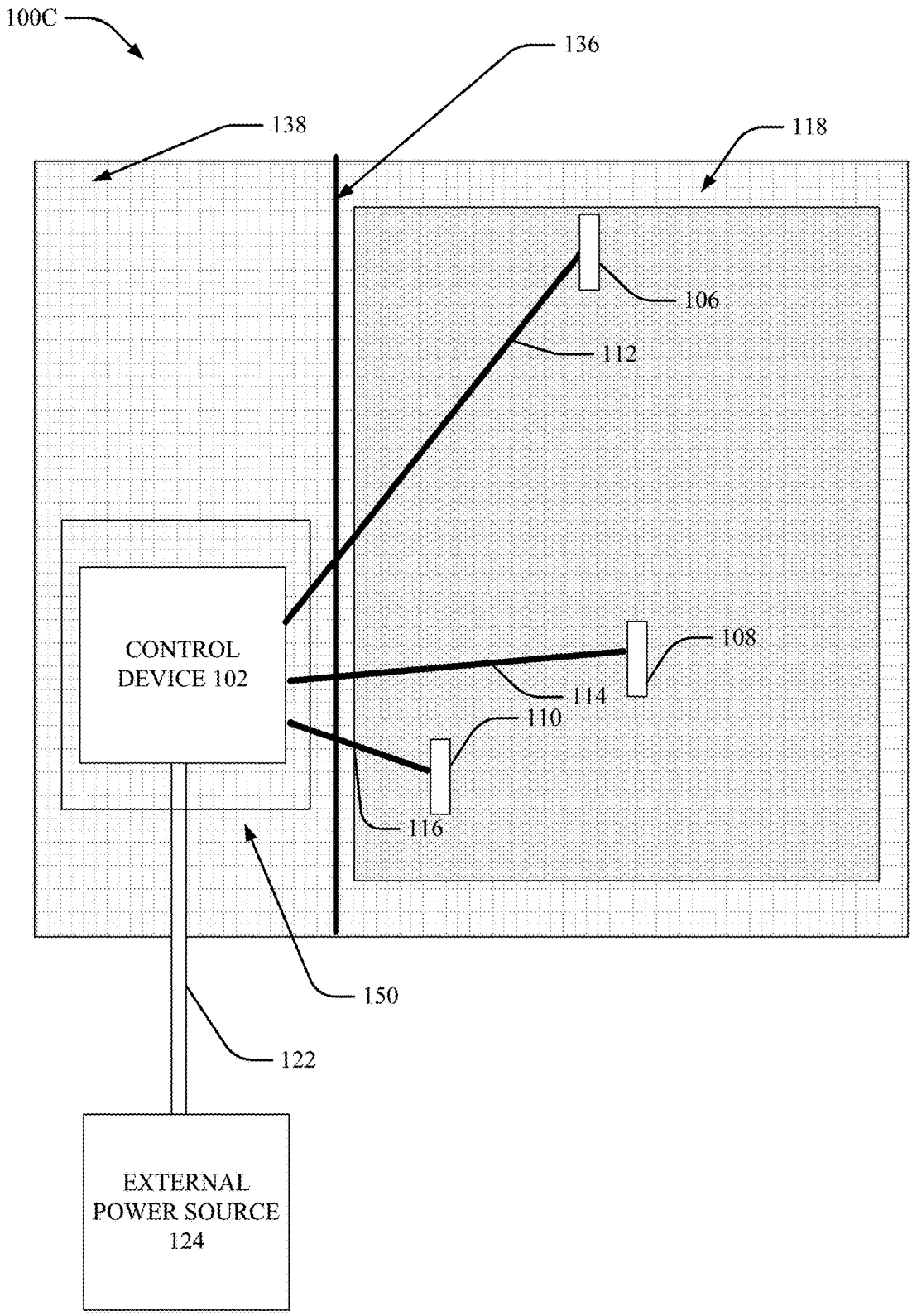

FIGS. 1A, 1B, and 1C illustrate example, non-limiting partial views of schematic diagrams of IERs (e.g., 100A, 100B, 100C) in accordance with one or more embodiments described herein. Repetitive description of like elements employed in other embodiments described herein is omitted for sake of brevity.

The partial views of the IERs 100A, 100B, 100C can be a view showing various components of the IERs 100A, 100B, 100C including control device, power source 104 and/or one or more illumination elements 106, 108, 110. As shown, the control device 102, power source 104 and/or one or more illumination elements 106, 108, 110 can be electrically and/or communicatively coupled to one another to perform one or more functions of the IERs 100A, 100B, 100C.

In some embodiments, the illumination elements 106, 108, 110 can be or include light emitting diodes (LEDs), light bulbs or any other component configured to become illuminated upon receipt of power. Any number of different technologies can be employed that provide illumination and are envisaged within the scope of this disclosure.

The power source 104 can be removable from the IERs 100A, 100B in some embodiments to allow the IERs 100A, 100B to be washed and/or cleaned. For example, in some embodiments, the power source 104 can be plugged/unplugged into the control device 102 and/or the IER 100A, 100B, 100C in general. In some embodiments, the power source 104 can include a switch 126 that can allow the power source 104 to be manually turned on or off (e.g., by a human, for example). While the switch 126 is shown inside the receptacle, in some embodiments, the switch 126 can be located on the outside of the receptacle (on the outer wall 118, for example) so that the switch 126 is accessible to a consumer that may hold the receptacle in his/her hand. The switch 126 can be located at the bottom of the receptacle such that the switch is adjacent a surface on which the receptacle is sitting in some embodiments. In some embodiments, the switch 126 can be located near the bottom region on the side of the receptacle.

In various embodiments, the power source 104 can include at least one battery (e.g., one or more batteries or a battery pack) in various embodiments. In other embodiments, the power source 104 can be other sources of power, including, but not limited to, solar cells charged by removing the power source 104 from the IER 100A, 100B and providing allowing sunlight to be applied to the solar cells. All such embodiments are envisaged.

Further, in some embodiments, such as IER 100C, the control device 102 can be coupled to an electrical connection 122 (e.g., electrical cord) configured to enable the control device to receive power from an external power source 124 (e.g., an electrical outlet, one or more batteries or the like). As shown, in some embodiments, the IER 100A can include a removable portion 132 that can be detached by any number of approaches and can include the control device 102 and/or the power source 104. For example, the removable portion can be sized to be telescopically attached to the bottom portion 134 of the receptacle 100. As another example, the removable portion can be configured with ridges that can enable the removable portion 132 to be screwed onto the bottom portion 134 of the receptacle 100. In some embodiments, such as that shown in FIG. 1A, the removable portion is at the bottom portion 134 of the receptacle; however, in other embodiments, the removable portion is at the side portion 138 of the IER 100C such as that shown in FIG. 3C.

In some embodiments, the inner ridge of the IERs 100A, 100B, 100C can include a seal 136 that can prevent or reduce the likelihood of water entry into the removable portion. In some embodiments, the seal 136 can be a silicon ring, a rubber ring or any other ring or material that is substantially waterproof.

Shown is a side view, and from this view, the control device, power source 104 and/or one or more illumination elements 106, 108, 110 can be disposed over or on (or, in some embodiments, through) the outer wall 118 of the IERs 100A, 100B, 100C. In some embodiments, the illumination elements 106, 108, 110 are disposed on or within an inner wall (not shown) of the receptacles 100A, 100B, 100C.

As shown, the outer wall 118 of the IER 100A, 100B, 100C and can be any suitable material for a receptacle including, but not limited to, plastic, aluminum, porcelain, ceramic or the like.

In some embodiments, the outer wall 118 can be transparent or translucent. A design printed on a sheet 130 (e.g., a polyvinyl chloride (PVC) sheet) can be shown through the outer wall 118. For example, the sheet 130 can be positioned adjacent and/or substantially parallel to and inside the outer wall 118 so that at least a portion of the sheet 130 is visible through the outer wall 118. The illumination elements 106, 108, 110 can be provided at particular locations on the paper. While PVC is indicated, in various embodiments, sheets 130 can be of any type of material that can receive the illumination elements 106, 108, 110 and/or to which the illumination elements 106, 108, 110 can be adhered or mechanically coupled can be employed including, but not limited to, ethylene vinyl acetate and/or ethylene vinyl acetate polyethylene. All such embodiments are envisaged. The partial view shows the IERs 100A, 100B, 100C open with the inner wall (not shown) removed.

Accordingly, in some embodiments, the IER 100A can be a double walled plastic receptacle with LED lights inside of the receptacle. The LEDs can be glued or otherwise adhered to the back side of a printed paper or PVC sheet so that the placement of the LEDs can match up with the printed design and/or form a design by placement of the LEDs on the outer surface of the printed paper or sheet (adjacent the outer wall 118 and between the sheet 130 and the outer wall 118). The photo below is a 3d printed prototype. In production the plastic will be clear, so the printed design is visible. The battery, etc. will be in a section at the bottom that screws on. It seals with a silicon ring so the receptacle is hand washable.

In some embodiments, the sheet 130 can be provided outside the outer wall 118 on the portion of the IERs 100A, 100B, 100C held by a user of the receptacle and therefore the outer wall 118 can be opaque in some embodiments.

Figure 3A:
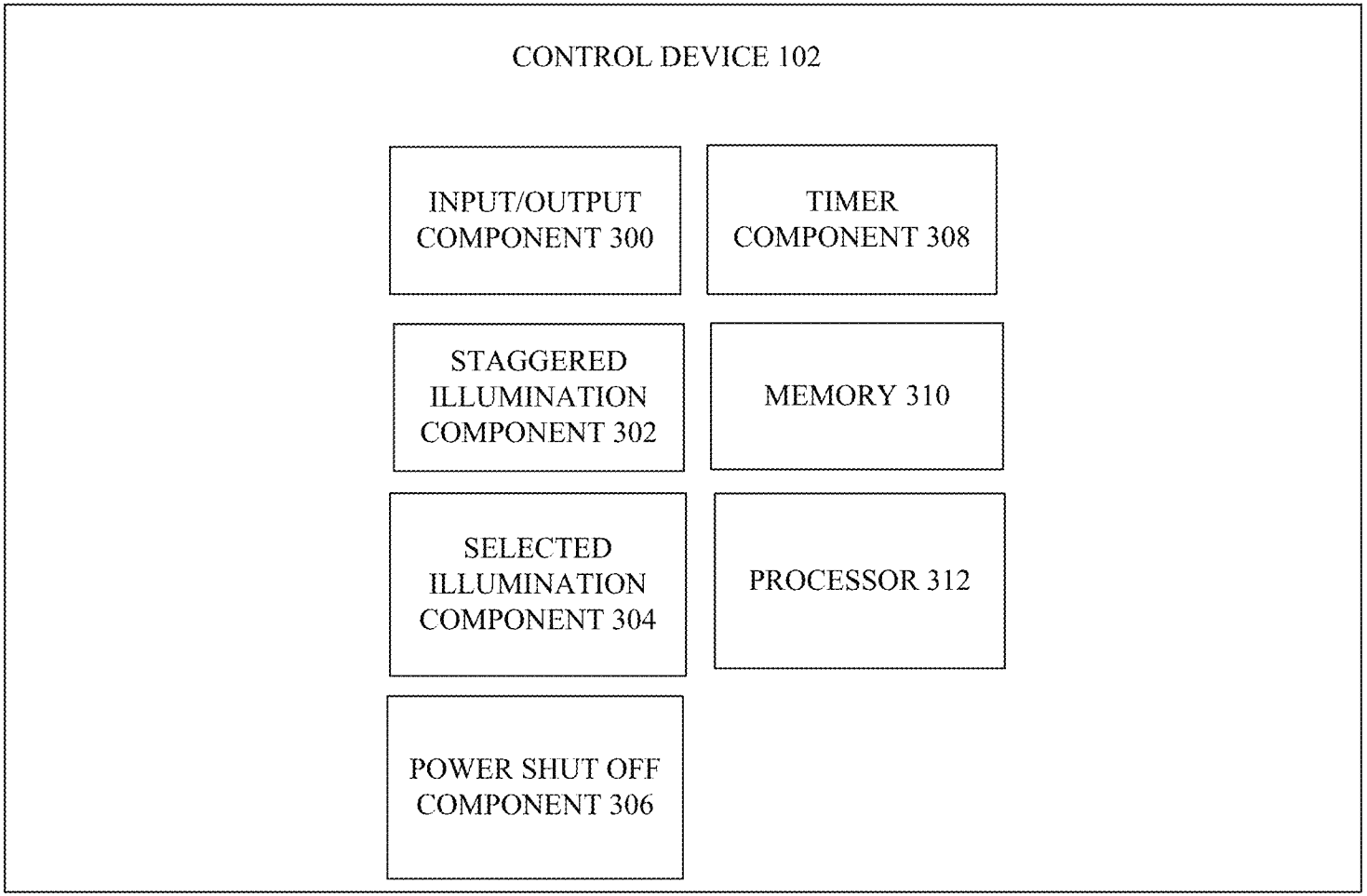
FIGS. 3A and 3B illustrate example, non-limiting block diagrams of a control device of an IER in accordance with one or more embodiments described herein.
Figure 3B:
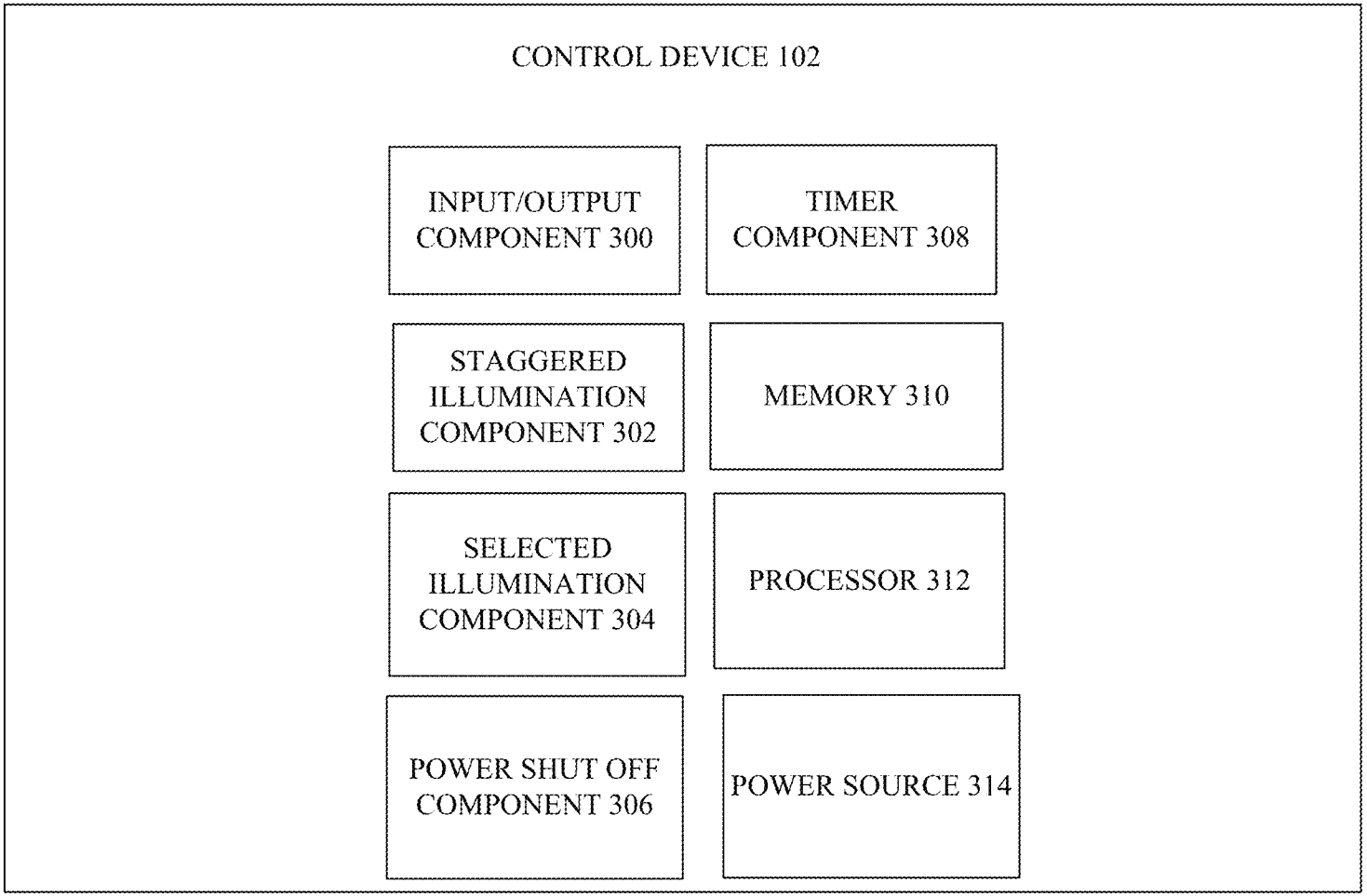

As shown in FIGS. 1A, 1B, 1C, there can be numerous different approaches to connecting the power source 104, control device 102 and/or one or more illumination elements 106, 108, 110 to control illumination of the IER 100A, 100B, 100C. These approaches will be described in more detail with reference to the control device of FIGS. 3A and 3B. FIGS. 3A and 3B illustrate example, non-limiting block diagrams of a control device of an IER in accordance with one or more embodiments described herein. In some embodiments, the control device 102 can be or can include an integrated circuit/chip to perform one or more of the functions of the control device 102.

As shown in FIG. 3A, control device 102 can comprise an input/output (I/O) component 300 configured to output one or more signals to the power source 104 for control of the power source (and/or control of illumination of the illumination elements 106, 108, 110 via the power source 104). In some embodiments, the I/O component 300 can receive one or more signals from the power source 104. In some embodiments, the I/O component 300 can include a power supply cable to power the control device. The control device 102 can also include a staggered illumination component 302 and/or selected illumination component 304 that can generate one or more signals to the power source 104 causing the power source 104 to output power to particular electrical connections connected to illuminated elements that are to be illuminated. The staggered illumination component can output signals causing the illumination of the illumination elements 106, 108, 110 to be staggered in a particular pattern or manner and the selected illumination component can output signals causing one or more illumination elements 106, 108, 110 to be concurrently illuminated (e.g., either for the entire time the power source 104 is connected to the IER 100A, 100B, 100C or for a defined amount of time).

The power shut off component 306 can control the power source 104 to power down. In some embodiments, the power shut off component 306 can control the power source to automatically (without human intervention) shut down after a defined amount of time that the power source 104 has been turned on. Accordingly, in some embodiments, the timer component 308 can track a time that the power source 104 has been turned on and generate a signal causing the control device 102 to output a signal for turning the power source 104 when a defined amount of time has passed that the power source 104 has been turned on.

As shown in FIG. 3B, in some embodiments, the control device 102 can comprise its own power source 314 enabling the control device 102 to power up or power down without separate power source 104. In some embodiments, the power source 104 can be the power source 314 and therefore can reside within the control device 102.

With reference to FIGS. 3A and 3B, the memory 310 can comprise computer-executable instructions that can be executed by the processor 312. For example, the computer executable instructions can include patterns for staggered illumination or information for selected illumination (e.g., the information for selected illumination can comprise information forming a particular design relative to printing on the first layer or otherwise when one or more of the illumination elements 106, 108, 110 are illuminated, for example).

With reference to FIGS. 1A, 3A, 3B, the control device 102 and each of the illumination elements 106, 108, 110 are electrically connected to the power source 104 to receive power from the power source 104. Upon receiving power from the power source 104, one or more of the illumination elements 106, 108, 110 can become illuminated. As shown, the electrical connections 112, 114, 116 between the power source 104 and the respective illumination elements 106, 108, 110 can be separate in some embodiments so as to enable the power source 104 to provide power to only selected ones of the illumination elements 106, 108, 110 at any particular time. Accordingly, each of the electrical connections 112, 114, 116 can be connected to a particular illumination element. For example, in some embodiments, the control device 102 can generate a signal that can be received by the power source 104 causing the power source 104 to turn on or off designated ones of the illumination elements 106, 108, 110 (e.g., via the staggered illumination component 302 or the selected illumination component 304).

Thus, in some embodiments, the power source 104 can provide power to all illumination elements 106, 108, 110 to cause all illumination elements 106, 108, 110 to become illuminated concurrently while at other times, the illumination may be generated at only a subset of illumination elements 106, 108, 110 based on power being provided from the power source 104 to that corresponding subset of illumination elements 106, 108, 110.

In some embodiments, the power source 104 can provide power in a staggered manner in the illumination elements 106, 108, 110 are provided power in a particular pattern or order to cause the illumination elements 106, 108, 110 to become illuminated and then turn off (when power ceases to be provided to that particular one of the illumination elements 106, 108, 110 by the power source 104). Accordingly, in different embodiments, different patterns of illumination between one or more of the illumination elements 106, 108, 110 over time can be displayed via the IERs 100A, 100B, 100C.

With reference to FIGS. 1B, 3A, 3B, the control device 102 and each of the illumination elements 106, 108, 110 are electrically connected to one another and the control device 102 is connected to the power source 104 to receive power from the power source 104 and to control illumination of one or more of the illumination elements 106, 108, 110.

With reference to FIGS. 1C, 3A, 3B, the control device 102 and each of the illumination elements 106, 108, 110 are electrically connected to one another and the control device 102 is connected to the external power source 124 to receive power from the external power source 124 and to control illumination of one or more of the illumination elements 106, 108, 110.

Figure 1D:
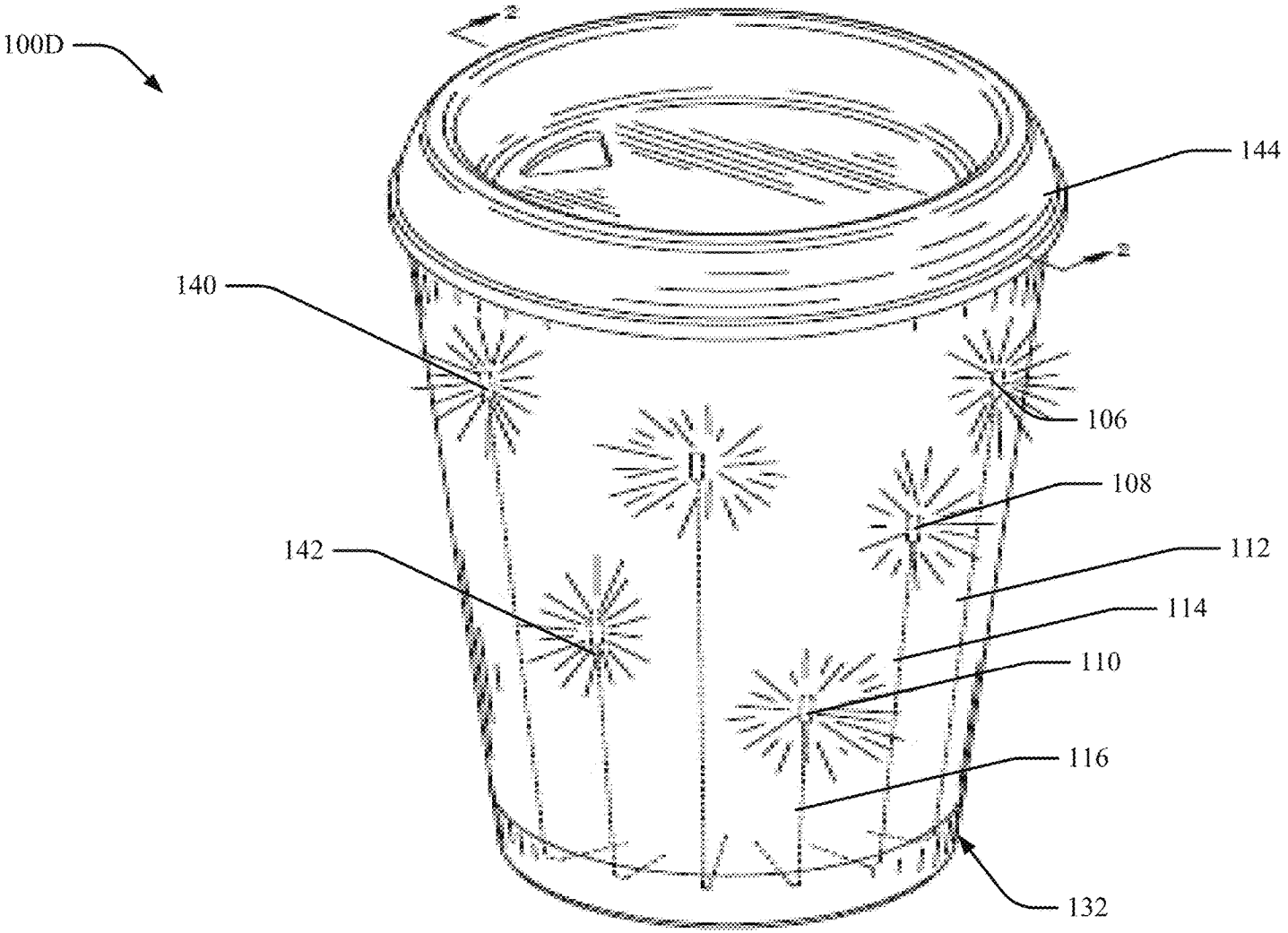
FIG. 1D illustrates an example, non-limiting perspective view of a schematic diagram of an illumination element receptacle in accordance with one or more embodiments described herein.
Figure 1E:
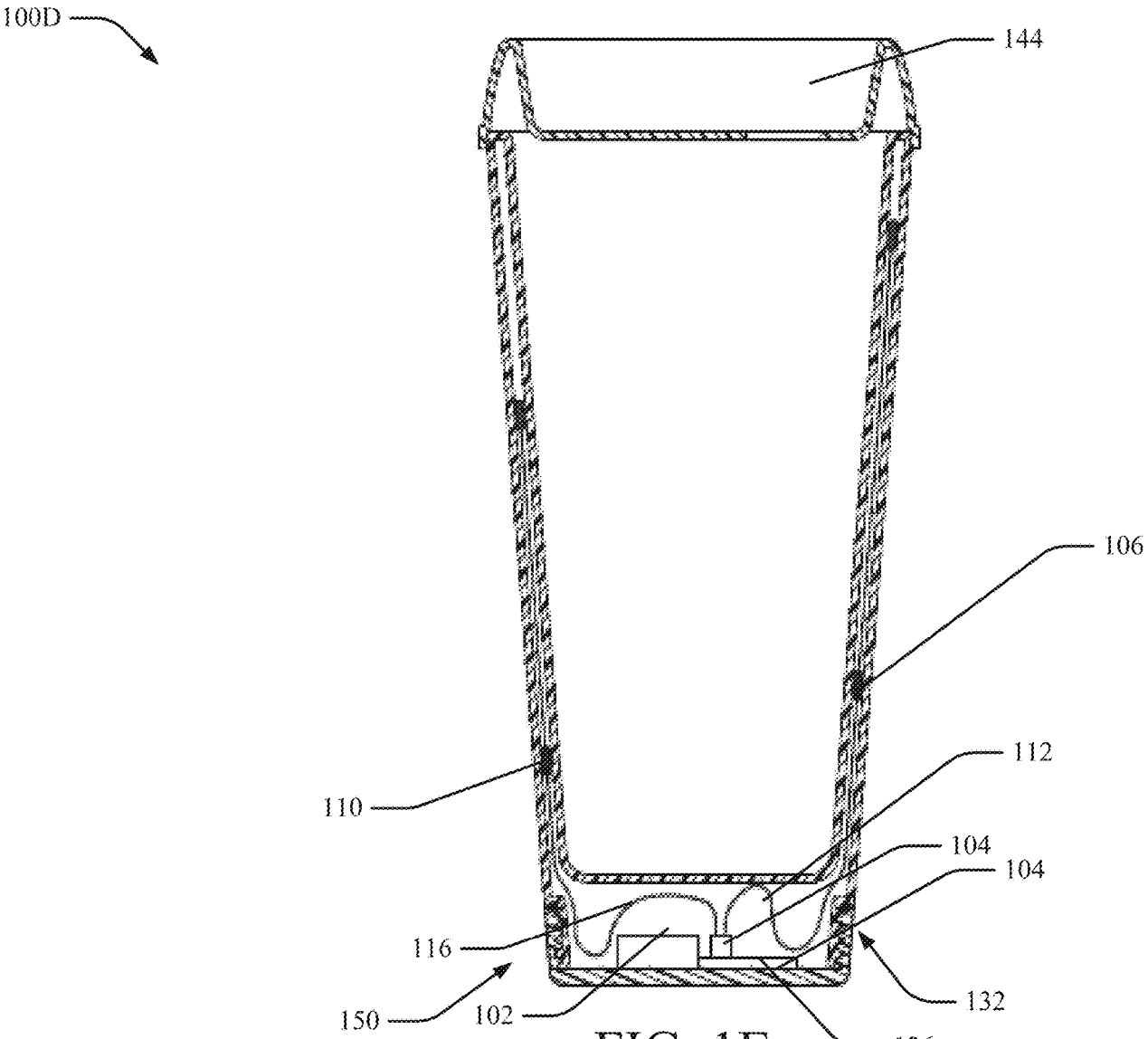
FIG. 1E illustrates an example, non-limiting cross-sectional side view of a schematic diagram of an illumination element receptacle in accordance with one or more embodiments described herein.
Figure 1F:
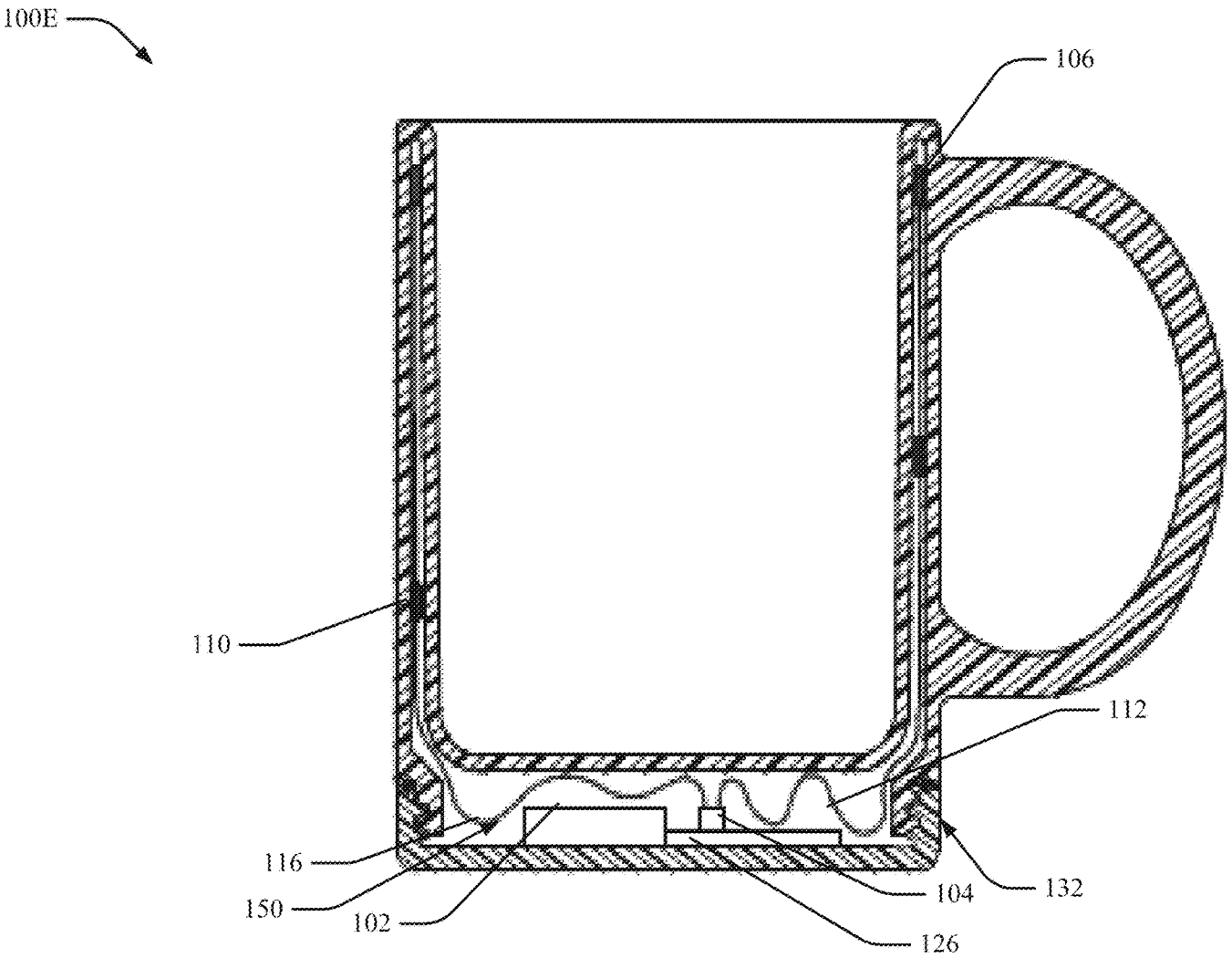
FIG. 1F illustrates another example, non-limiting cross-sectional side view of a schematic diagram of an illumination element receptacle in accordance with one or more embodiments described herein.

FIG. 1D illustrates an example, non-limiting perspective view of a schematic diagram of an illumination element receptacle in accordance with one or more embodiments described herein. FIG. 1E illustrates an example, non-limiting cross-sectional side view of a schematic diagram of an illumination element receptacle in accordance with one or more embodiments described herein. For example, FIG. 1E can be the cross-sectional view dividing the receptacle of FIG. 1D along the lines 2-2. FIG. 1F illustrates another example, non-limiting cross-sectional side view of a schematic diagram of an illumination element receptacle in accordance with one or more embodiments described herein. Repetitive description of like elements employed in other embodiments described herein is omitted for sake of brevity.

Figure 2B:
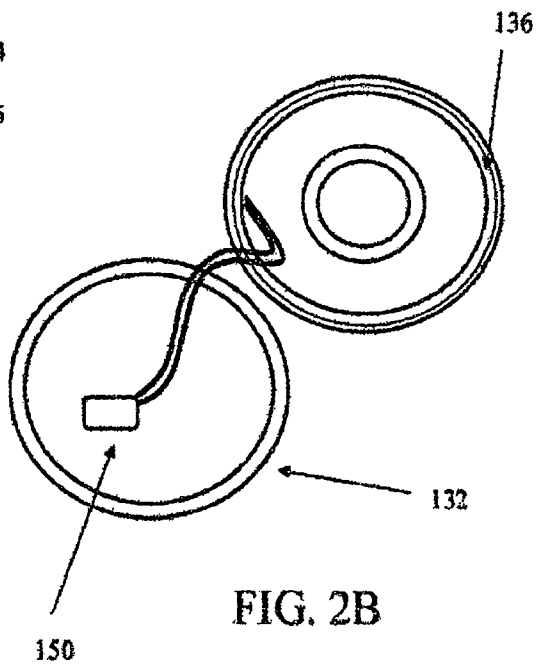
FIGS. 2A and 2B illustrate example, non-limiting cross-sectional view of an illumination element receptacle and a removed bottom portion of the illumination element receptacle in accordance with one or more embodiments described herein.
Figure 2A:
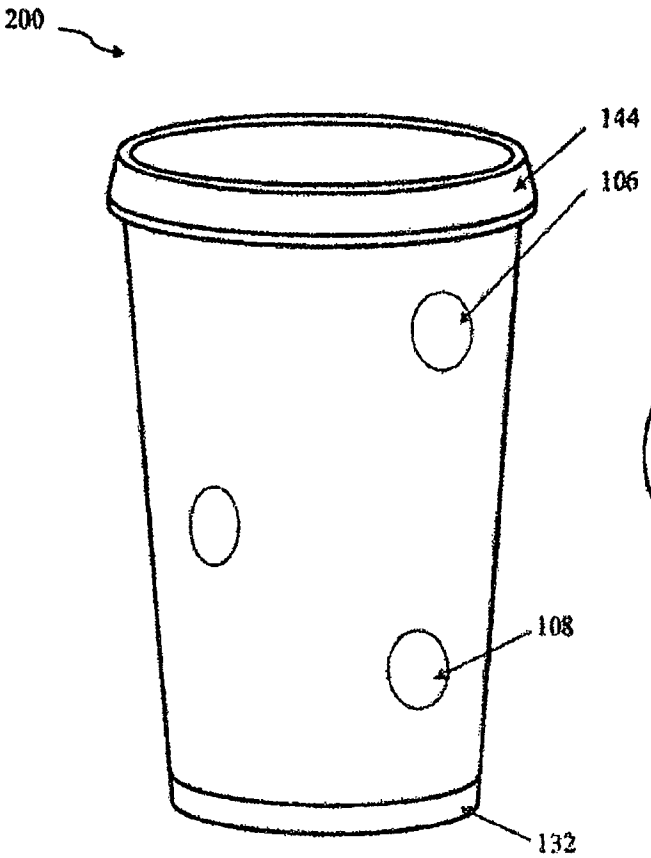

FIGS. 2A and 2B illustrate example, non-limiting cross-sectional view of an illumination element receptacle and a removed bottom portion of the illumination element receptacle in accordance with one or more embodiments described herein. Repetitive description of like elements employed in other embodiments described herein is omitted for sake of brevity.

With reference to FIGS. 1D, 1E, 1F, 2A, and 2B, in the embodiments shown in FIGS. 1D, 1E and 1F, the IERs 100D, 100E have the electrical connections 112, 116 connected to the battery 104 in lieu of being directly connected to the control device 102. As such, in various different embodiments, the electrical connections (e.g., electrical connections 112, 116, 114) can be connected directly to the control device 102 (as shown in FIGS. 1A, 1B and 1C), the battery 104 and/or the switch 126 for the battery 104. In some embodiments, the receptacle can be a cup (as shown in FIGS. 1D and 1E) and/or a mug (as shown in FIG. 1F). As shown in FIGS. 1D and 1E, in some embodiments, the cup can include a cover 144 or other top for reducing the likelihood of spillage of fluid located inside the cup.

As shown, inside of the removable portion can be circuitry 150. As used herein, the term "circuitry" can include in whole or in part, but is not limited to, power source 104, control device 102, one or more integrated circuits/chips that perform one or more functions, electrical connections 112, 114, 116, an electrical connector 122 and/or one or more illumination elements 106, 108, 110. The illumination elements 106, 108, 110 can be dispersed through or attached to (e.g., via adhesive, mechanically coupled, sewn or the like).

In some other embodiments, the illumination elements 106, 108, 110 can be provided in any number of different configurations to illustrate different lighted designs and/or to display different shapes or structures of lighted objects. As such, the illumination elements 106, 108, 110 can be placed to correspond with the design printed on the sheet 130.

In some embodiments, the illumination elements 106, 108, 110 can be placed to correspond to a design on the printed sheet while in some embodiments, one or more the illumination elements 106, 108, 110 can be placed to form designs and/or objects (e.g., regular polygons, irregular polygons, swirl design elements, objects formed from combining one or more polygons, commonplace objects (e.g., houses, cars, people). For example, in FIG. 1E, numerous illumination elements (e.g., illumination elements 106, 108, 110, 140, 142) can be positioned as part of the design printed on the printed sheet 130. In other embodiments, the illumination elements 106, 108, 110 can be positioned to form a design on the printed sheet 130.

Thus, in some embodiments, the illumination elements can be positioned as part of a pre-printed design or can form a design in various different embodiments. All such embodiments are envisaged.

Although in embodiments described herein only various illumination elements are labeled (e.g., 106, 108, 110, 140, 142) in some embodiments, any number of illumination elements can be provided as part of the IER 100A, 100B, 100C, 100D, 100E, 200 and all such embodiments are envisaged.

Figure 4:
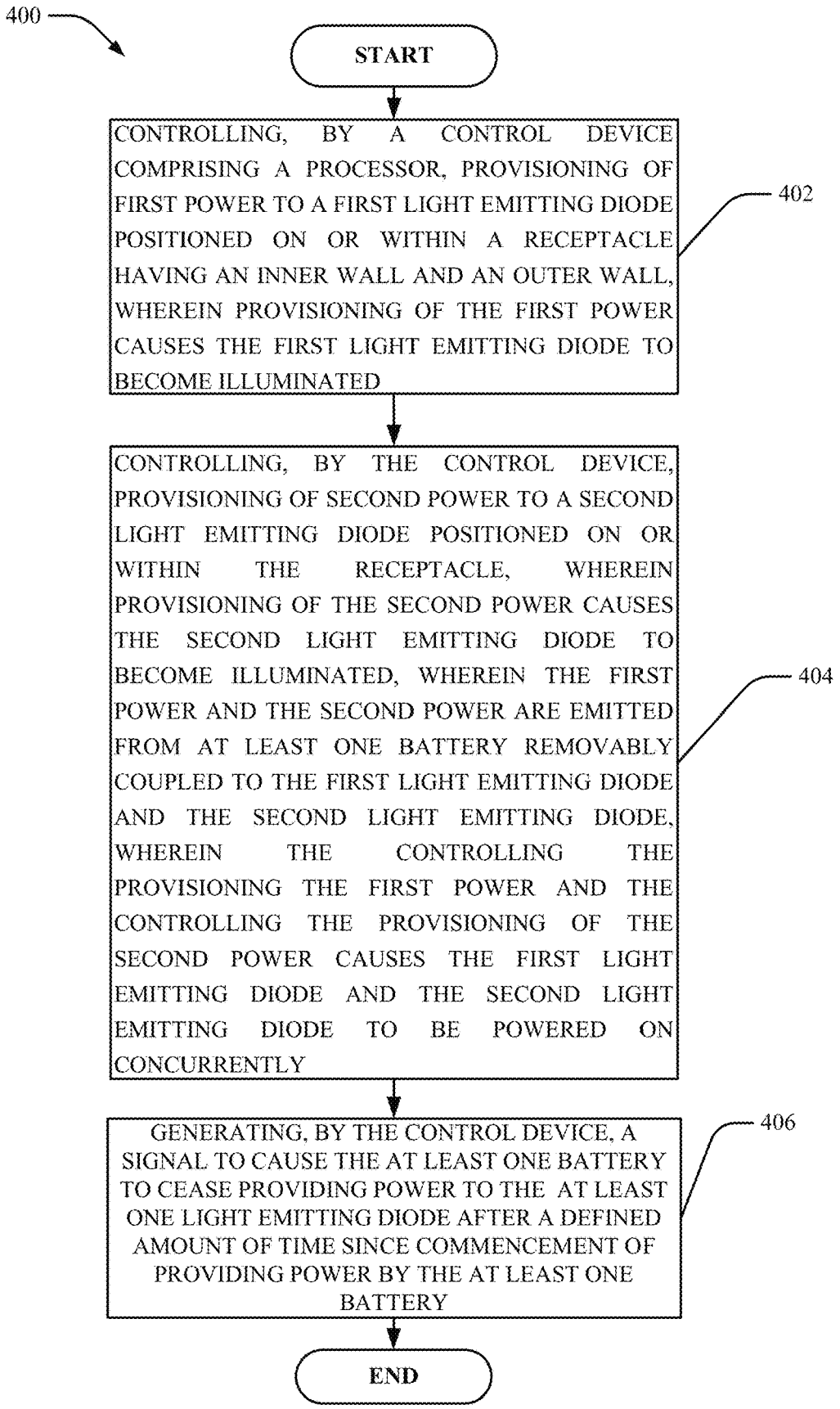
FIGS. 4 and 5 illustrate flow charts of methods of operation of an IER in accordance with one or more embodiments described herein.
Figure 5:
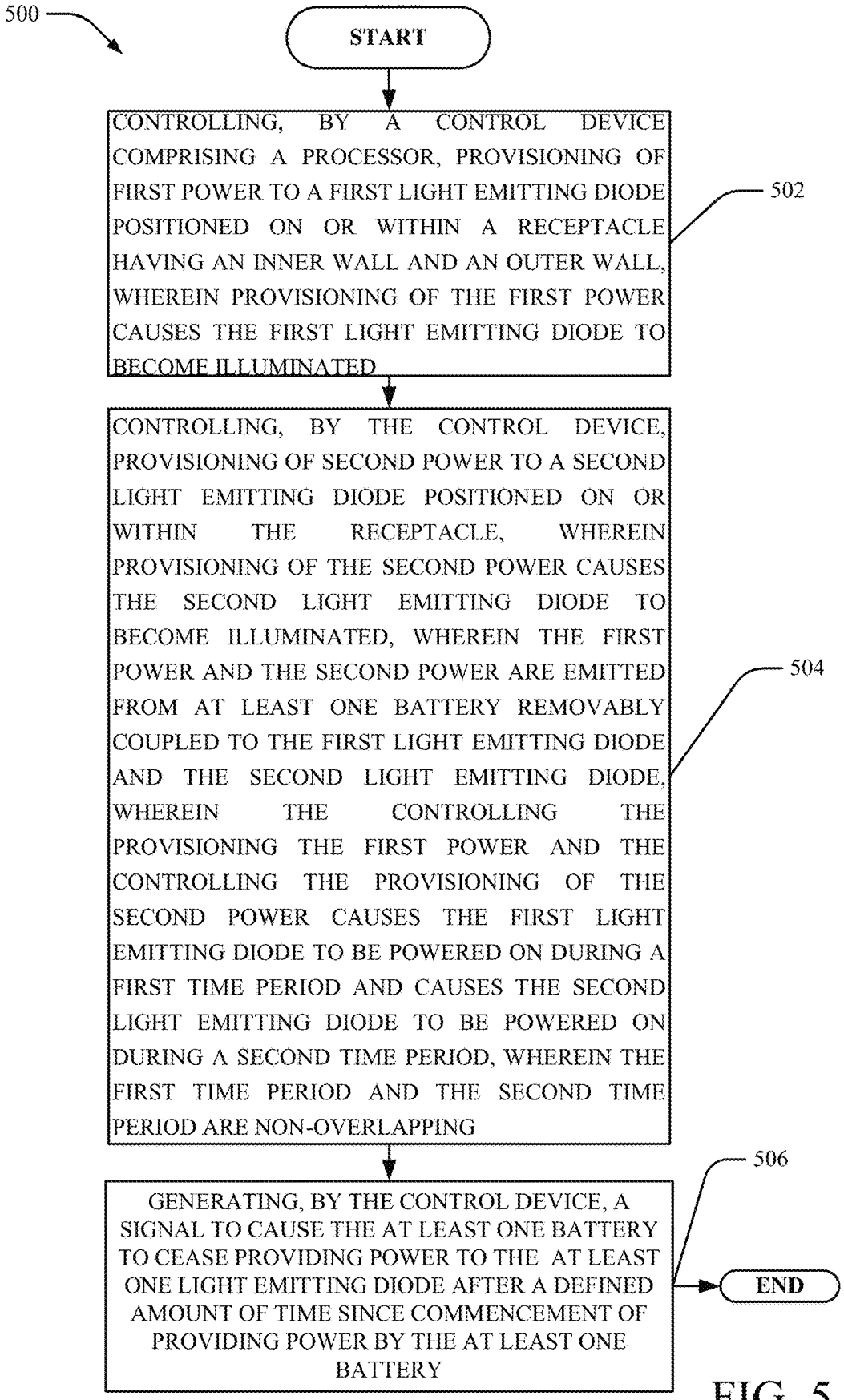

FIGS. 4 and 5 illustrate flow charts of methods of operation of an illumination element receptacle in accordance with one or more embodiments described herein. Repetitive description of like elements employed in other embodiments described herein is omitted for sake of brevity.

Turning first to FIG. 4, at 402, method 400 can comprise controlling, by a control device (e.g., control device 102), provisioning of first power to a first light emitting diode positioned on or within a receptacle having an inner wall and an outer wall, wherein provisioning of the first power causes the first light emitting diode to become illuminated.

At 404, method 400 can comprise controlling, by the control device (e.g., control device 102), provisioning of second power to a second light emitting diode positioned on or within the receptacle, wherein provisioning of the second power causes the second light emitting diode to become illuminated, wherein the first power and the second power are emitted from a battery pack removably coupled to the first light emitting diode and the second light emitting diode, wherein controlling the provisioning the first power and the controlling the provisioning of the second power causes the first light emitting diode and the second light emitting diode to be powered on concurrently.

In some embodiments, method 400 can also comprise, at 406, generating, by the control device, a signal to cause the at least one battery to cease providing power to the at least one light emitting diode after a defined amount of time since commencement of providing power by the at least one battery.

Turning now to FIG. 5, at 502, method 500 can comprise controlling, by a control device, provisioning of first power to a first light emitting diode positioned on or within a receptacle having a first layer and a second layer, wherein provisioning of the first power causes the first light emitting diode to become illuminated.

At 504, method 500 can comprise controlling, by the control device, provisioning of second power to a second light emitting diode positioned on or within the receptacle, wherein provisioning of the second power causes the second light emitting cause the at least one battery to cease providing power to the at least one light emitting diode after a defined amount of time since commencement of providing power by the at least one battery.

In some embodiments, method 500 can also comprise, at 506, generating, by the control device, a signal to cause the at least one battery to cease providing power to the at least one light emitting diode after a defined amount of time since commencement of providing power by the at least one battery.

Figure 6:
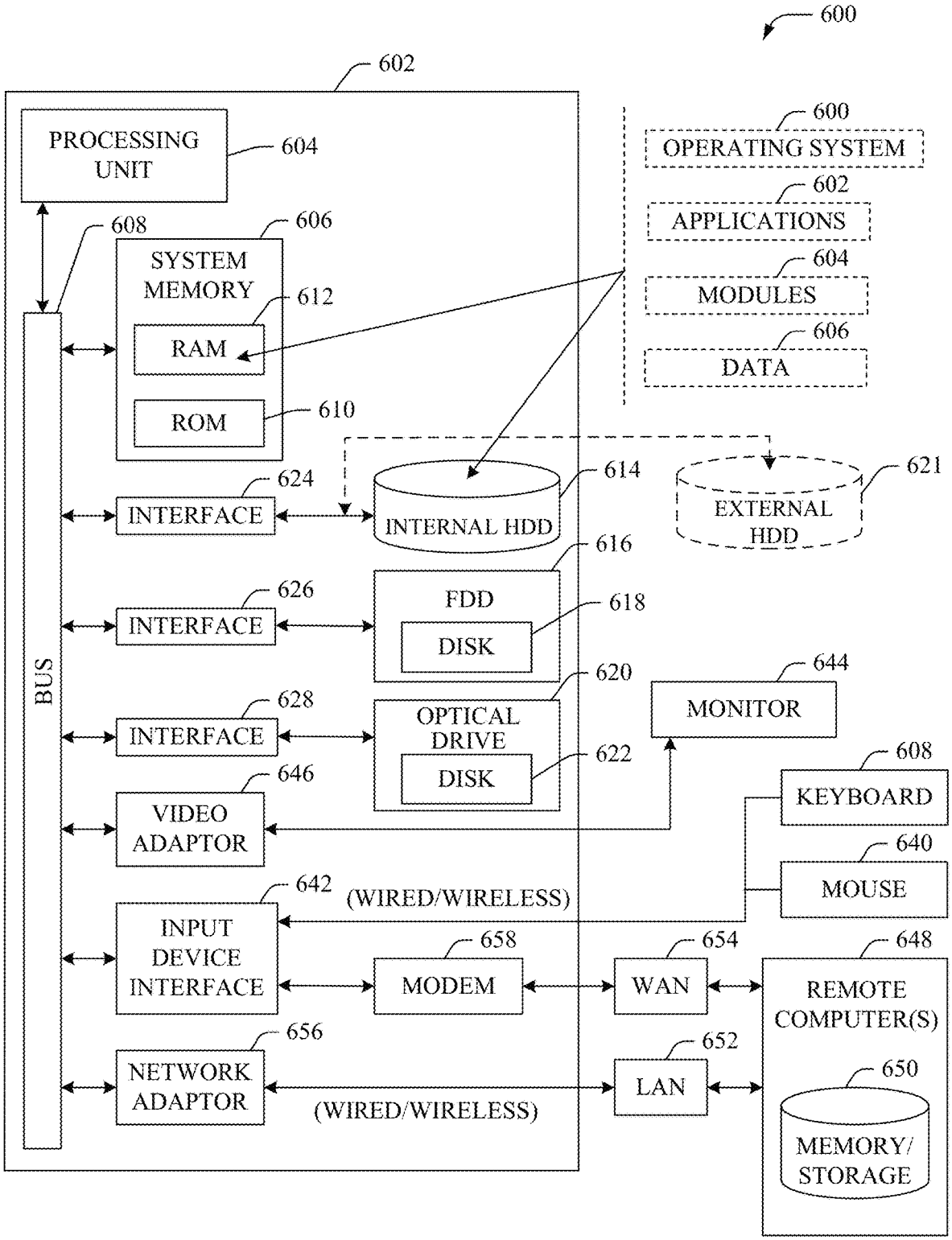
FIG. 6 illustrates a block diagram of a computer that can be employed in accordance with one or more embodiments described herein.

FIG. 6 illustrates a block diagram of a computer that can be employed in accordance with one or more embodiments. Repetitive description of like elements employed in other embodiments described herein is omitted for sake of brevity. In some embodiments, the computer, or a component of the computer, can be or be comprised within any number of components described herein comprising, but not limited to, IERs 100A, 100B, 100C, 100D, 100E, 200, control device 102, power source 104, illumination elements 106, 108, 110 (or components of IER 100A, 100B, 100C, 100D, 100E, 200, control device 102, power source 104, illumination elements 106, 108, 110).

In order to provide additional text for various embodiments described herein, FIG. 6 and the following discussion are intended to provide a brief, general description of a suitable computing environment 600 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules comprise routines, programs, components, data structures, etc., that perform particular tasks or implement particular abstract data types. Moreover, those skilled in the art will appreciate that the inventive methods can be practiced with other computer system configurations, comprising single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The terms "first," "second," "third," and so forth, as used in the claims, unless otherwise clear by context, is for clarity only and doesn't otherwise indicate or imply any order in time. For instance, "a first determination," "a second determination," and "a third determination," does not indicate or imply that the first determination is to be made before the second determination, or vice versa, etc.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically comprise a variety of media, which can comprise computer-readable (or machine-readable) storage media and/or communications media, which two terms are used herein differently from one another as follows. Computer-readable (or machine-readable) storage media can be any available storage media that can be accessed by the computer (or a machine, device or apparatus) and comprises both volatile and nonvolatile media, removable and non-removable media. By way of example, and not limitation, computer-readable (or machine-readable) storage media can be implemented in connection with any method or technology for storage of information such as computer-readable (or machine-readable) instructions, program modules, structured data or unstructured data. Tangible and/or non-transitory computer-readable (or machine-readable) storage media can comprise, but are not limited to, random access memory (RAM), read only memory (ROM), electrically erasable programmable read only memory (EEPROM), flash memory or other memory technology, compact disk read only memory (CD-ROM), digital versatile disk (DVD) or other optical disk storage, magnetic cassettes, magnetic tape, magnetic disk storage, other magnetic storage devices and/or other media that can be used to store desired information. Computer-readable (or machine-readable) storage media can be accessed by one or more local or remote computing devices, e.g., via access requests, queries or other data retrieval protocols, for a variety of operations with respect to the information stored by the medium.

In this regard, the term "tangible" herein as applied to storage, memory or computer-readable (or machine-readable) media, is to be understood to exclude only propagating intangible signals per se as a modifier and does not relinquish coverage of all standard storage, memory or computer-readable (or machine-readable) media that are not only propagating intangible signals per se.

In this regard, the term "non-transitory" herein as applied to storage, memory or computer-readable (or machine-readable) media, is to be understood to exclude only propagating transitory signals per se as a modifier and does not relinquish coverage of all standard storage, memory or computer-readable (or machine-readable) media that are not only propagating transitory signals per se.

Communications media typically embody computer-readable (or machine-readable) instructions, data structures, program modules or other structured or unstructured data in a data signal such as a modulated data signal, e.g., a channel wave or other transport mechanism, and comprises any information delivery or transport media. The term "modulated data signal" or signals refers to a signal that has one or more of its characteristics set or changed in such a manner as to encode information in one or more signals. By way of example, and not limitation, communication media comprise wired media, such as a wired network or direct-wired connection, and wireless media such as acoustic, RF, infrared and other wireless media.

With reference again to FIG. 6, the example environment 600 for implementing various embodiments of the embodiments described herein comprises a computer 602, the computer 602 comprising a processing unit 604, a system memory 606 and a system bus 608. The system bus 608 couples system components comprising, but not limited to, the system memory 606 to the processing unit 604. The processing unit 604 can be any of various commercially available processors. Dual microprocessors and other multiprocessor architectures can also be employed as the processing unit 604.

The system bus 608 can be any of several types of bus structure that can further interconnect to a memory bus (with or without a memory controller), a peripheral bus, and a local bus using any of a variety of commercially available bus architectures. The system memory 606 comprises ROM 610 and RAM 612. A basic input/output system (BIOS) can be stored in a non-volatile memory such as ROM, erasable programmable read only memory (EPROM), EEPROM, which BIOS contains the basic routines that help to transfer information between elements within the computer 602, such as during startup. The RAM 612 can also comprise a high-speed RAM such as static RAM for caching data.

The computer 602 further comprises an internal hard disk drive (HDD) 610 (e.g., EIDE, SATA), which internal hard disk drive 614 can also be configured for external use in a suitable chassis (not shown), a magnetic floppy disk drive 616, (e.g., to read from or write to a removable diskette 618) and an optical disk drive 620, (e.g., reading a CD-ROM disk 622 or, to read from or write to other high capacity optical media such as the DVD). The hard disk drive 614, magnetic disk drive 616 and optical disk drive 620 can be connected to the system bus 608 by a hard disk drive interface 624, a magnetic disk drive interface 626 and an optical drive interface, respectively. The interface 624 for external drive implementations comprises at least one or both of Universal Serial Bus (USB) and Institute of Electrical and Electronics Engineers (IEEE) 1394 interface technologies. Other external drive connection technologies are within contemplation of the embodiments described herein.

The drives and their associated computer-readable (or machine-readable) storage media provide nonvolatile storage of data, data structures, computer-executable instructions, and so forth. For the computer 602, the drives and storage media accommodate the storage of any data in a suitable digital format. Although the description of computer-readable (or machine-readable) storage media above refers to a hard disk drive (HDD), a removable magnetic diskette, and a removable optical media such as a CD or DVD, it should be appreciated by those skilled in the art that other types of storage media which are readable by a computer, such as zip drives, magnetic cassettes, flash memory cards, cartridges, and the like, can also be used in the example operating environment, and further, that any such storage media can contain computer-executable instructions for performing the methods described herein.

A number of program modules can be stored in the drives and RAM 612, comprising an operating system 630, one or more application programs 632, other program modules 634 and program data 636. All or portions of the operating system, applications, modules, and/or data can also be cached in the RAM 612. The systems and methods described herein can be implemented utilizing various commercially available operating systems or combinations of operating systems.

A communication device can enter commands and information into the computer 602 through one or more wired/wireless input devices, e.g., a keyboard 638 and a pointing device, such as a mouse 640. Other input devices (not shown) can comprise a microphone, an infrared (IR) remote control, a joystick, a game pad, a stylus pen, touch screen or the like. These and other input devices are often connected to the processing unit 604 through an input device interface 642 that can be coupled to the system bus 608, but can be connected by other interfaces, such as a parallel port, an IEEE 1394 serial port, a game port, a universal serial bus (USB) port, an IR interface, etc.

A monitor 644 or other type of display device can be also connected to the system bus 608 via an interface, such as a video adapter 646. In addition to the monitor 644, a computer typically comprises other peripheral output devices (not shown), such as speakers, printers, etc.

The computer 602 can operate in a networked environment using logical connections via wired and/or wireless communications to one or more remote computers, such as a remote computer(s) 648. The remote computer(s) 648 can be a workstation, a server computer, a personal computer, portable computer, microprocessor-based entertainment appliance, a peer device or other common network node, and typically comprises many or all of the elements described relative to the computer 602, although, for purposes of brevity, only a memory/storage device 650 is illustrated. The logical connections depicted comprise wired/wireless connectivity to a local area network (LAN) 652 and/or larger networks, e.g., a wide area network (WAN) 654. Such LAN and WAN networking environments are commonplace in offices and companies, and facilitate enterprise-wide computer networks, such as intranets, all of which can connect to a global communications network, e.g., the Internet.

When used in a LAN networking environment, the computer 602 can be connected to the local network 652 through a wired and/or wireless communication network interface or adapter 656. The adapter 656 can facilitate wired or wireless communication to the LAN 652, which can also comprise a wireless AP disposed thereon for communicating with the wireless adapter 656.

When used in a WAN networking environment, the computer 602 can comprise a modem 658 or can be connected to a communications server on the WAN 654 or has other means for establishing communications over the WAN 654, such as by way of the Internet. The modem 658, which can be internal or external and a wired or wireless device, can be connected to the system bus 608 via the input device interface 642. In a networked environment, program modules depicted relative to the computer 602 or portions thereof, can be stored in the remote memory/storage device 650. It will be appreciated that the network connections shown are example and other means of establishing a communications link between the computers can be used.

The computer 602 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This can comprise Wireless Fidelity (Wi-Fi) and BLUETOOTH® wireless technologies. Thus, the communication can be a defined structure as with a conventional network or simply an ad hoc communication between at least two devices.

Wi-Fi can allow connection to the Internet from a couch at home, a bed in a hotel room or a conference room at work, without wires. Wi-Fi is a wireless technology similar to that used in a cell phone that enables such devices, e.g., computers, to send and receive data indoors and out; anywhere within the range of a femto cell device. Wi-Fi networks use radio technologies called IEEE 802.11 (a, b, g, n, etc.) to provide secure, reliable, fast wireless connectivity. A Wi-Fi network can be used to connect computers to each other, to the Internet, and to wired networks (which can use IEEE 802.11 or Ethernet). Wi-Fi networks operate in the unlicensed 2.4 and 5 GHz radio bands, at an 10 Mbps (802.11a) or 54 Mbps (802.11b) data rate, for example or with products that contain both bands (dual band), so the networks can provide real-world performance similar to the basic 10 Base T wired Ethernet networks used in many offices.

The embodiments described herein can employ artificial intelligence (AI) to facilitate automating one or more features described herein. The embodiments (e.g., in connection with automatically identifying acquired cell sites that provide a maximum value/benefit after addition to an existing communication network) can employ various AI-based schemes for carrying out various embodiments thereof. Moreover, the classifier can be employed to determine a ranking or priority of each cell site of an acquired network. A classifier is a function that maps an input attribute vector, $x=(x1, x2, x3, x4, \ldots, xn)$, to a confidence that the input belongs to a class, that is, $f(x)=\text{confidence}(\text{class})$. Such classification can employ a probabilistic and/or statistical-based analysis (e.g., factoring into the analysis utilities and costs) to prognose or infer an action that a communication device desires to be automatically performed. A support vector machine (SVM) is an example of a classifier that can be employed. The SVM operates by finding a hypersurface in the space of possible inputs, which the hypersurface attempts to split the triggering criteria from the non-triggering events. Intuitively, this makes the classification correct for testing data that is near, but not identical to training data. Other directed and undirected model classification approaches comprise, e.g., naïve Bayes, Bayesian networks, decision trees, neural networks, fuzzy logic models, and probabilistic classification models providing different patterns of independence can be employed. Classification as used herein also is inclusive of statistical regression that is utilized to develop models of priority.

As will be readily appreciated, one or more of the embodiments can employ classifiers that are explicitly trained (e.g., via a generic training data) as well as implicitly trained (e.g., via observing communication device behavior, operator preferences, historical information, receiving extrinsic information). For example, SVMs can be configured via a learning or training phase within a classifier constructor and feature selection module. Thus, the classifier(s) can be used to automatically learn and perform a number of functions, comprising but not limited to determining according to a predetermined criteria which of the acquired cell sites will benefit a maximum number of subscribers and/or which of the acquired cell sites will add minimum value to the existing communication network coverage, etc.

As employed herein, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components or any combination thereof designed to perform the functions described herein. Processors can exploit nano-scale architectures such as, but not limited to, molecular and quantum-dot based transistors, switches and gates, in order to optimize space usage or enhance performance of communication device equipment. A processor can also be implemented as a combination of computing processing units.

As used herein, terms such as "data storage," "database," and substantially any other information storage component relevant to operation and functionality of a component, refer to "memory components," or entities embodied in a "memory" or components comprising the memory. It will be appreciated that the memory components or computer-readable (or machine-readable) storage media, described herein can be either volatile memory or nonvolatile memory or can comprise both volatile and nonvolatile memory.

Memory disclosed herein can comprise volatile memory or nonvolatile memory or can comprise both volatile and nonvolatile memory. By way of illustration, and not limitation, nonvolatile memory can comprise read only memory (ROM), programmable ROM (PROM), electrically programmable ROM (EPROM), electrically erasable PROM (EEPROM) or flash memory. Volatile memory can comprise random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). The memory (e.g., data storages, databases) of the embodiments are intended to comprise, without being limited to, these and any other suitable types of memory.

What has been described above comprises mere examples of various embodiments. It is, of course, not possible to describe every conceivable combination of components or methodologies for purposes of describing these examples, but one of ordinary skill in the art can recognize that many further combinations and permutations of the present embodiments are possible. Accordingly, the embodiments disclosed and/or claimed herein are intended to embrace all such alterations, modifications and variations that fall within the spirit and scope of the appended claims. Furthermore, to the extent that the term "comprises" is used in either the detailed description or the claims, such term is intended to be inclusive in a manner similar to the term "comprising" as "comprising" is interpreted when employed as a transitional word in a claim.

What is claimed is:

1. A cup for holding fluid, comprising:

an inner wall;

an outer wall, wherein the inner wall and the outer wall form a double walled receptacle for holding the fluid;

circuitry disposed between the inner wall and the outer wall, the circuitry comprising at least one light emitting diode; and a removable portion that is configured to be detachable from the double walled receptacle and electrically decoupled from the circuitry when detached, and is electrically coupled to the circuitry when attached to the receptacle, the removable portion comprising a control device removably coupled to the at least one light emitting diode, wherein the control device is configured to control illumination of the at least one light emitting diode, wherein the removable portion further comprises inner ridge and a sealing material that forms a waterproof seal with the double walled receptacle when the removable portion is attached to the double walled receptacle.

2. The cup for holding fluid of claim 1, further comprises a printed sheet disposed between the inner wall and the outer wall and having the at least one light emitting diode disposed on the printed sheet.

3. The cup for holding fluid of claim 1, wherein the outer wall is at least one of transparent or translucent to display the at least one light emitting diode through the outer wall.

4. The cup for holding fluid of claim 1, wherein the removable portion further comprises a power source coupled to the control device and configured to provide power to the control device and the at least one light emitting diode, wherein the power source is removably coupled to the circuitry, and wherein the power source comprises at least one battery.

5. The cup for holding fluid of claim 4, wherein the at least one battery is coupled to a switch that controls the at least one battery to provide power to the control device and the at least one light emitting diode.

6. The cup for holding fluid of claim 1, further comprising a power connection component coupled to the control device, wherein the power connection component is configured to be removably coupled to a power source external to the article of manufacture to provide power to the control device and the at least one light emitting diode.

7. The cup for holding fluid of claim 1, further comprising at least one other light emitting diode, wherein the control device is configured to output a signal causing the at least one light emitting diode and the at least one other light emitting diode to have staggered illumination, wherein the staggered illumination comprises the at least one light emitting diode commencing illuminating at a first time and the at least one other light emitting diode commencing illumination at a second time, wherein the second time is later than the first time.

8. The cup for holding fluid of claim 7, wherein the control device is configured to output a signal causing the at least one light emitting diode and the at least one other light emitting diode to illuminate.

9. The cup for holding fluid of claim 4, wherein the control device comprises a power shut off component configured to automatically shut off power from the at least one battery.

10. The cup for holding fluid of claim 9, wherein the power shut off component is further configured to automatically shut off power from the at least one battery after a defined amount of time that the at least one battery has provided power to the at least one light emitting diode.

11. The cup for holding fluid of claim 1, wherein the outer wall is comprised of ceramic, plastic or porcelain.

12. The cup for holding fluid of claim 1, further comprising a removable lid covering the double walled receptacle.

13. The cup for holding fluid of claim 1, wherein the sealing material is a silicon ring or a rubber ring.

14. The cup for holding fluid of claim 1, wherein the removable portion is configured to attach to a bottom of the double walled receptacle.

* * * * *